US009293279B1

(12) United States Patent
Bamford et al.

(10) Patent No.: US 9,293,279 B1
(45) Date of Patent: Mar. 22, 2016

(54) COAXIAL SWITCH

(71) Applicants: David J Bamford, Wakefield, RI (US); Adam P Crisafulli, Somerset, MA (US)

(72) Inventors: David J Bamford, Wakefield, RI (US); Adam P Crisafulli, Somerset, MA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 136 days.

(21) Appl. No.: 14/259,252

(22) Filed: Apr. 23, 2014

(51) Int. Cl.
*H01H 19/14* (2006.01)
*H01H 19/04* (2006.01)
*H01H 25/06* (2006.01)

(52) U.S. Cl.
CPC ..... *H01H 19/04* (2013.01); *H01H 25/06* (2013.01); *H01H 19/14* (2013.01)

(58) Field of Classification Search
CPC ..... H01H 25/06; H01H 19/14
USPC ..... 200/4, 566
See application file for complete search history.

(56) References Cited

U.S. PATENT DOCUMENTS 2,473,565 A * 6/1949 Bird ..... H01H 25/06 200/4
2,512,880 A * 6/1950 Russell ..... H01H 25/06 200/4
3,551,614 A * 12/1970 Babler ..... H01H 13/52 200/539

OTHER PUBLICATIONS

Coaxwitch RF Coaxial Switch Model 72R, Instruction sheet, pp. 1-3, Bird, USA.

* cited by examiner

*Primary Examiner* — Felix O Figueroa
(74) *Attorney, Agent, or Firm* — James M. Kasischke; Michael P. Stanley

(57) ABSTRACT

A coaxial switch having a housing and a shaft extending through and rotatably mounted to the housing. The shaft extends from opposite ends of the housing. Connector body members are attached to the housing and a support plate is mounted to the shaft. Conductor members are joined to the support plate. Each conductor member has a conductor and is configured to be inserted into a connector body member. The conductors of the conductor members are electrically connected together. When the coaxial switch is engaged, the conductor members are inserted into the connector body members. The coaxial switch becomes disengaged when a force is exerted on the shaft that causes the conductor members to be withdrawn from the connector body members. An axial force-producing mechanism produces a constant axial force on the shaft to maintain the coaxial switch in the engaged state.

4 Claims, 10 Drawing Sheets

COAXIAL SWITCH

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER PATENT APPLICATIONS

None.

BACKGROUND OF THE INVENTION (1) Field of the Invention

The present invention generally relates to a rotary coaxial switch that when the switch is engaged; conductor members are inserted into connector body members in the switch. A force-producing mechanism produces a constant force on a central shaft to maintain the coaxial switch in an engaged conductive state. The switch becomes disengaged when a force stronger than the force producing mechanism is exerted on the shaft; thereby, causing the conductor members to be withdrawn from the connector body members.

(2) Description of the Prior Art

Coaxial switches are known in the art and are used in applications that require frequent transposition of two coaxial lines. For example, it may be necessary to switch an RF (radio frequency) receiver input between two different antennas. In such an application, two coaxial lines are connected to a RF coaxial switch; wherein, one coaxial line is connected to a first antenna and the other coaxial line is attached to a second antenna.

Some RF coaxial switches have a rotary-type configuration and utilize a shaft that can rotate to different positions in order to form an RF connection. One RF coaxial rotary switch is described in U.S. Pat. No. 2,697,767, entitled "Coaxial Switch" and another RF coaxial rotary switch is described in U.S. Pat. No. 2,432,476, entitled "Electrical Switch Device".

RF coaxial switches are typically used in environments that are prone to mechanical shocks and vibrations. For example, in military applications, the RF coaxial switches are mounted in racks that contain other equipment. As such, it is critical that a RF coaxial switch be able to withstand mechanical shocks and vibrations and to maintain an RF connection throughout a shock or a vibration event.

It has been found that shocks and vibrations on prior art rotary-type coaxial switches may cause the shaft in the coaxial switch to be displaced axially; thereby, breaking the RF connection. The displacement of the shaft causes the switch to reposition to a neutral position. The prior art RF coaxial rotary-type switches do not have any device or configuration to restore the RF connection without user intervention.

What is therefore needed is a coaxial switch that minimizes axial displacement of the switch shaft during a shock event so as to maintain connectivity.

SUMMARY OF THE INVENTION

The present invention is directed to a coaxial switch, with a housing having an inner wall surrounding an interior. A plurality of connector openings are in communication with the interior. The coaxial switch also comprises a plurality of coaxial connector body members mounted to the housing wherein each body member is mounted over a corresponding connector opening.

A shaft extends through and is rotatably mounted to the housing. The shaft has one section within the interior of the housing and another section extending from the opening in the housing at a first location. A further section extends from the opening in the housing at a second location.

The coaxial switch further comprises a support plate mounted to the section of the shaft that is within the interior of the housing. Conductor members are joined to the support plate wherein each conductor member has a conductor. Each conductor member is configured to be inserted into any of the coaxial connector body members.

The coaxial switch also comprises an axial force producing mechanism mounted to the section of the shaft extending from the housing at the first location. The mechanism produces a constant axial force on the shaft that urges the support plate against the inner wall so that the support plate impacts the connector openings in the housing.

The coaxial switch also includes a radial force producing member mounted on the shaft and adjacent to an intermediate section of the shaft. The intermediate section and the radial force producing member are drawn into a passageway of the housing when an axial force opposite to and greater than the force produced by the axial force producing mechanism is exerted on the shaft. The radial force producing member exerts a radial force on the shaft when the intermediate section forcibly contacts the radial force producing member within the passageway.

A knob is attached to the section of the shaft extending from the housing at the second location. The knob enables a user to pull the shaft in a direction that is opposite to the axial force produced by the axial force producing mechanism.

The knob can also rotate the shaft to a different position. Releasing the knob enables the axial force produced by the axial force-producing member to pull the support plate against the inner wall of the housing so that a pair of conductor members are inserted into the appropriate coaxial connector body members and the conductors of the conductor members contact the conductors of coaxial cables that are connected to the coaxial connector body members.

BRIEF DESCRIPTION OF THE DRAWINGS

A more complete understanding of the invention and many of the attendant advantages thereto will be appreciated as the same becomes better understood by reference to the following detailed description when considered in conjunction with the accompanying drawings wherein corresponding reference characters indicate corresponding parts throughout the several views of the drawings and wherein.

DETAILED DESCRIPTION OF THE INVENTION

Figure 1:
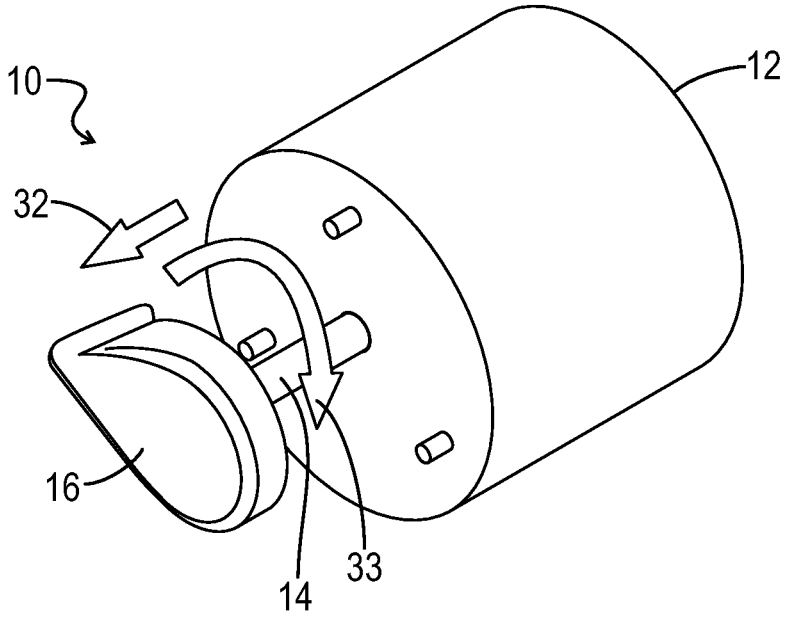
FIG. 1 (PRIOR ART)
FIG. 1 is a perspective view of a prior art coaxial switch.
Figure 2:
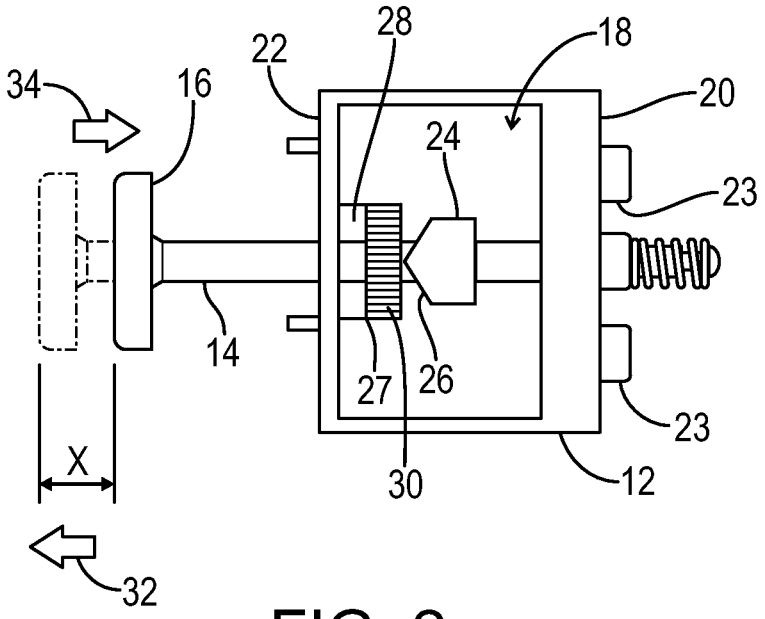
FIG. 2 (PRIOR ART)
FIG. 2 is a side view, in cross-section, of the prior art coaxial switch of FIG. 1.
Figure 3:
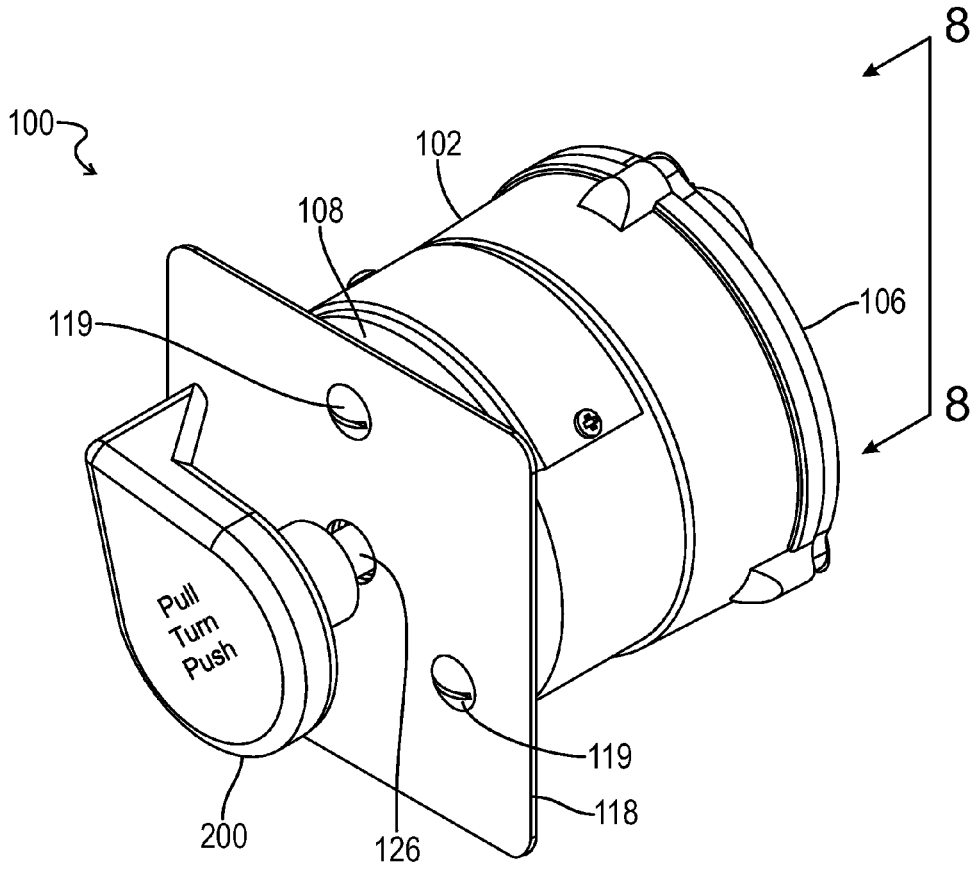
FIG. 3 is a front, perspective view of the coaxial switch of the present invention.
Figure 4:
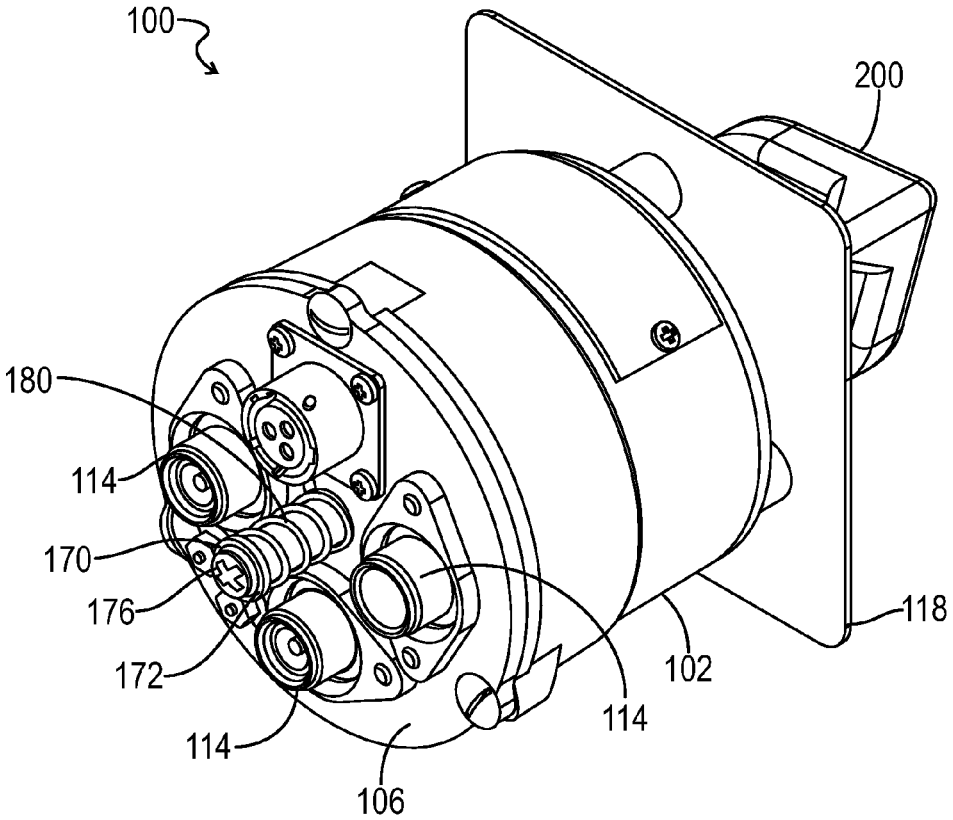
FIG. 4 is a rear, perspective view of the coaxial switch of FIG. 3.
Figure 5:
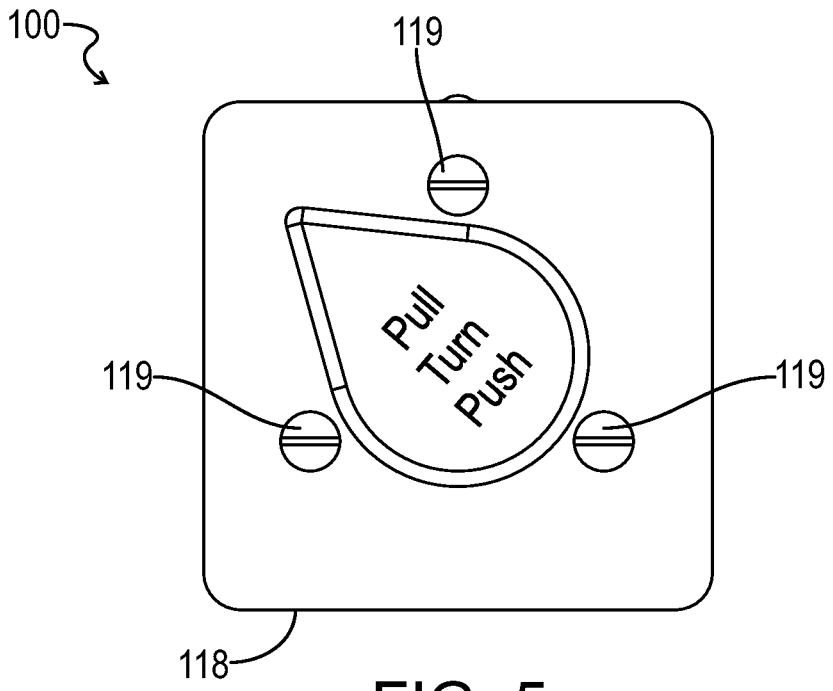
FIG. 5 is a front view of the coaxial switch of FIG. 3.
Figure 6:
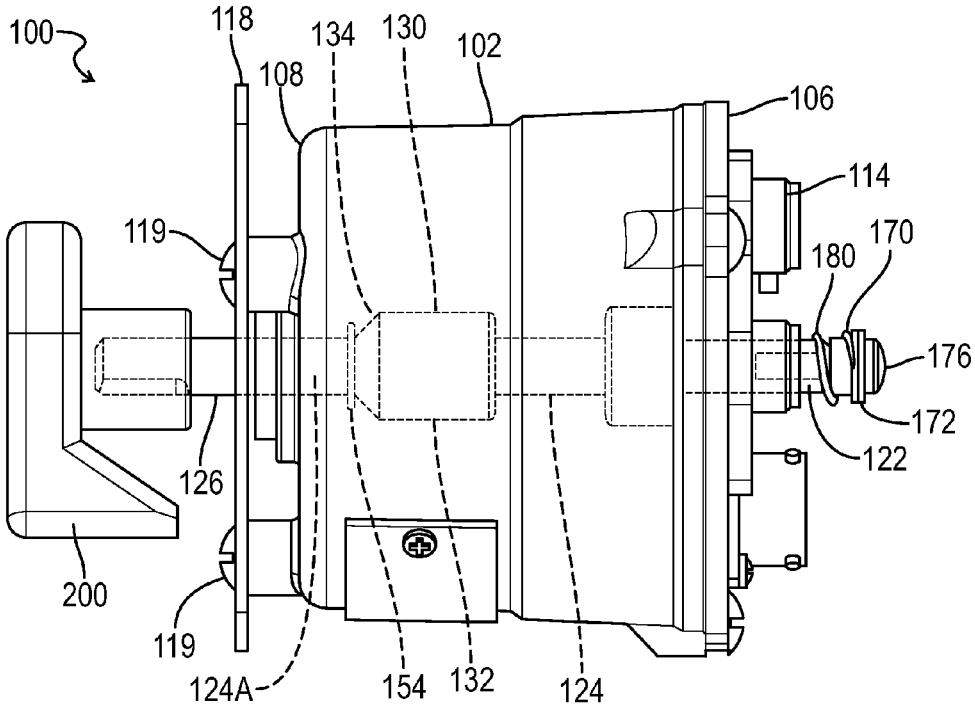
FIG. 6 is right side view of the coaxial switch of FIG. 3 with the view showing an intermediate section of the shaft and a radial force producing member in phantom.
Figure 7:
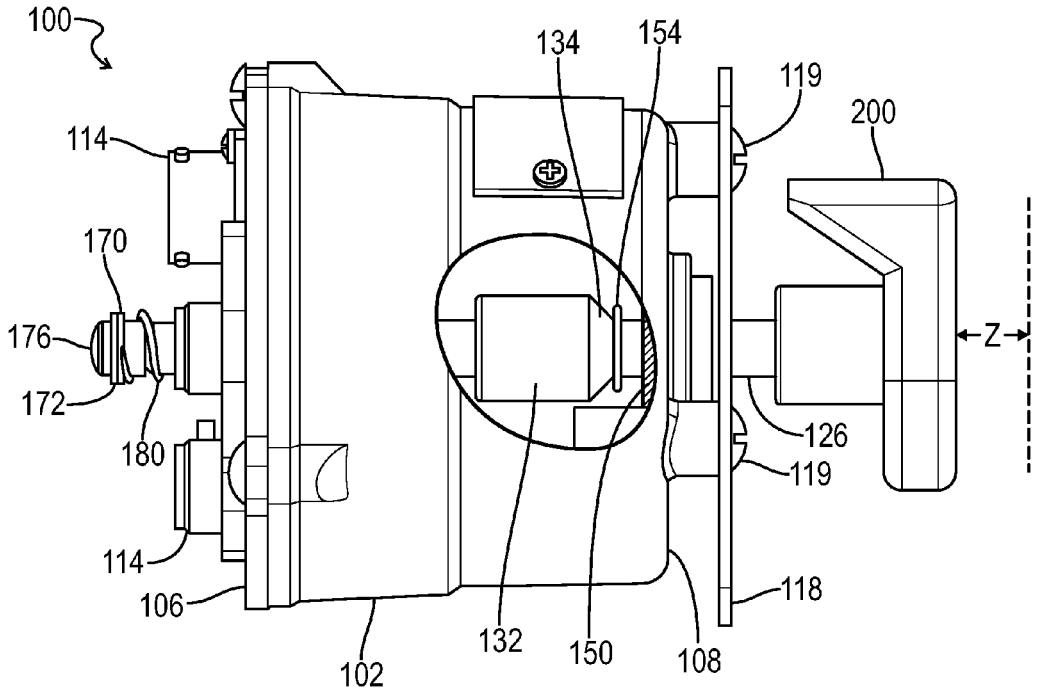
FIG. 7 is a left side view of the coaxial switch of FIG. 3 with the view also showing the intermediate section of the shaft within the interior of the housing.
Figure 8:
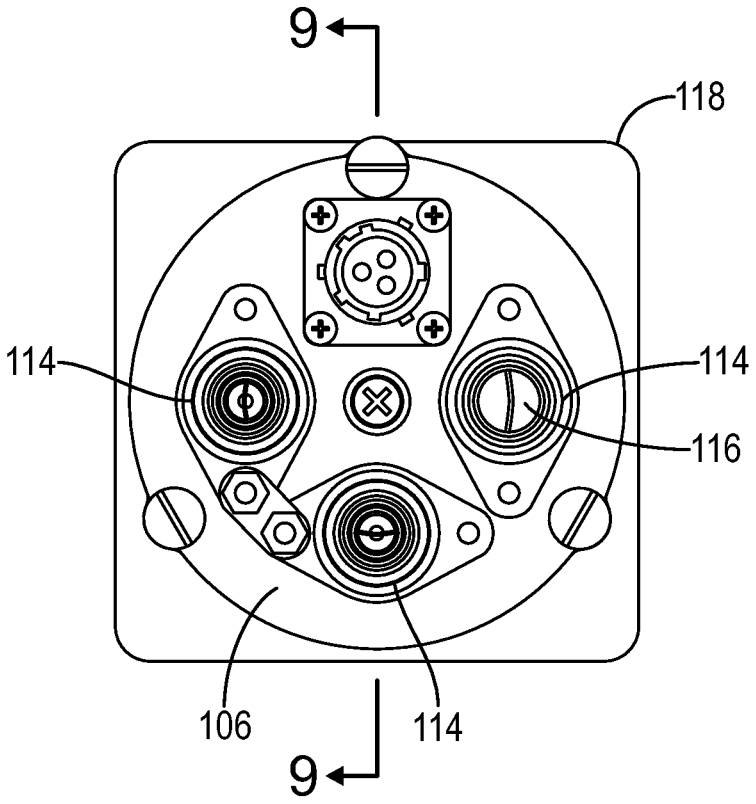
FIG. 8 is a rear view of the coaxial switch of FIG. 3.
Figure 9:
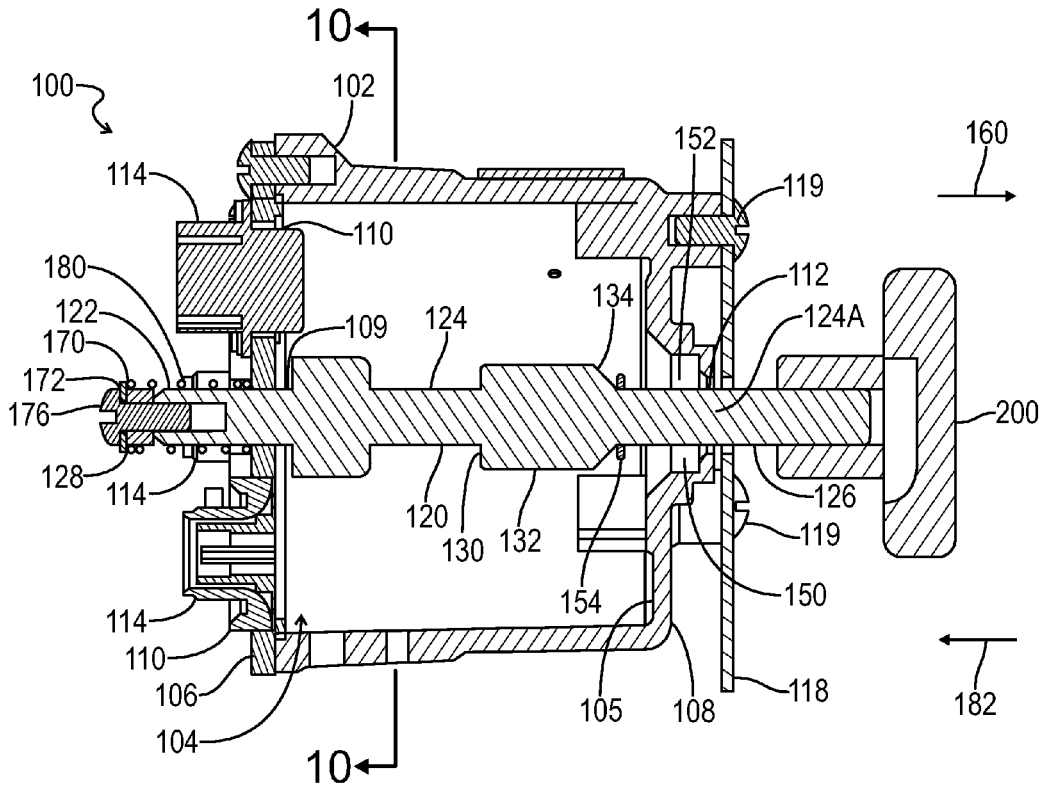
FIG. 9 is a cross-sectional view taken along reference line 9-9 in FIG. 8.

Referring to FIGS. 1 and 2; there is shown a prior art coaxial rotary switch 10. The switch 10 comprises a housing 12, a shaft 14 and a knob 16 which is attached to the shaft. The housing 12 has an interior 18, a first end 20 and opposite, a second end 22. A connector plate (not shown) having coaxial connectors is attached to the shaft 14. Coaxial connector body members 23 are mounted to the first end 20. The shaft 14 extends through a central opening in the first end 20 and through a central opening in the second end 22.

The shaft 14 includes a section 24 that is located within the interior 18. The section 24 has a diameter that is greater than the diameter of the remaining portion of the shaft 14. The section 24 includes a beveled or angled portion 26. The housing 12 also includes an annular structure 27 that defines a passageway 28 that leads to the central opening in the second end 22. A garter spring 30 is mounted to the shaft 14 and is adjacent to the beveled portion 26.

In order to disengage the switch 10; the user pulls the knob 16 in the direction of arrow 32 for a distance "X". The distance "X" is the distance that the shaft 14 can axially move for the annular structure 27 to contact the second end 22. Such movement of the shaft 14 causes the intermediate section 24 and the garter spring 30 to be pulled or drawn into the passageway 28 wherein the garter spring exerts a radial force on the shaft thereby creating resistance.

In order to engage the switch 10; the user rotates the shaft 14 (as indicated by direction 33) to a different position and then releases the knob 16 so that the knob moves in the direction indicated by arrow 34. The shaft 14 can rotate in clockwise and counter-clockwise directions (see FIG. 1). The garter spring 30 does not provide sufficient resistance to prevent the switch 10 from disengaging and breaking connectivity when a mechanical shock event occurs.

Referring to FIGS. 3-9, there is shown a coaxial switch 100 of the present invention. The coaxial switch 100 is a rotary-type coaxial switch and has a useful frequency range of DC to 10 GHz. The switch 100 comprises a housing 102 with an interior 104 and an inner wall 105. The housing 102 comprises a first end 106 and a second end 108. The first end 106 has a central opening 109 and a plurality of connector openings 110 arranged about the central opening. The second end 108 includes a central opening 112 that is aligned with the central opening 109. A plurality of coaxial connector body members 114 are mounted to the first end 106.

Each coaxial connector body member 114 is configured to be connected to a coaxial cable (not shown) and is mounted over a corresponding connector opening 110. Each coaxial connector body member 114 has an interior 116 which can be accessed through the interior 104 of the housing 102. A front plate 118 is attached to the second end 108 via screws or suitable fasteners 119.

The coaxial switch 100 further comprises a shaft 120 which extends through and is rotatably mounted to the housing 102. The shaft 120 has a first section 122 that extends through the central opening 109. The shaft 120 further comprises a second section 124 that extends through the interior 104 and a third section 126 which extends from the central opening 112.

The first section 122 has a diameter and extends to a distal end 128. The second section 124 comprises an intermediate section 130 with a generally cylindrical portion 132 and a beveled or angled portion 134. The cylindrical portion 132 has a diameter that is greater than the diameter of portion 124A of the shaft section 124. The difference in diameters between the cylindrical portion 132 and the portion 124A allows for the formation of the beveled or angled portion 134. The purpose of the intermediate section 130 is discussed in detail in the following description.

Figure 10:
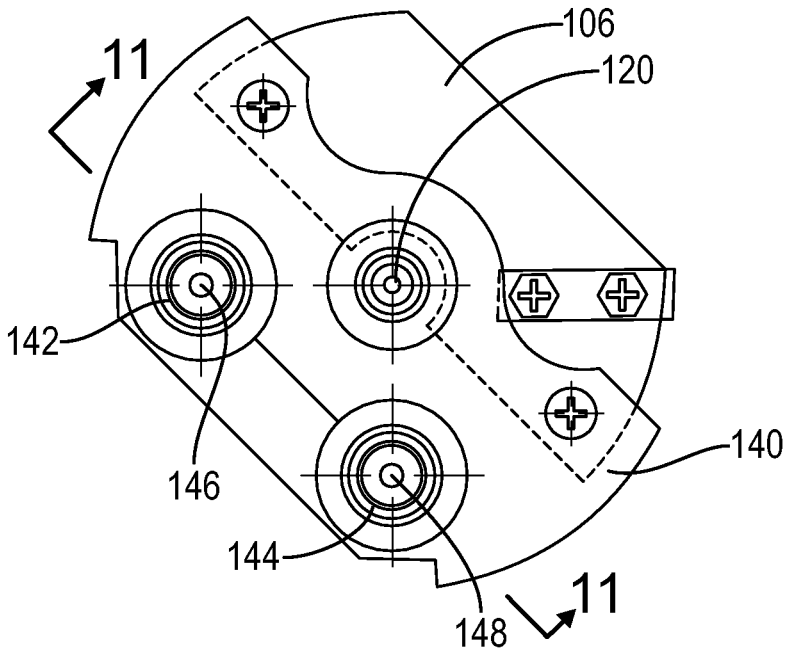
FIG. 10 is top view of a support plate that is attached to the shaft of the coaxial switch and located within the interior of the housing with the view taken along reference line 10-10 in FIG. 9.
Figure 11:
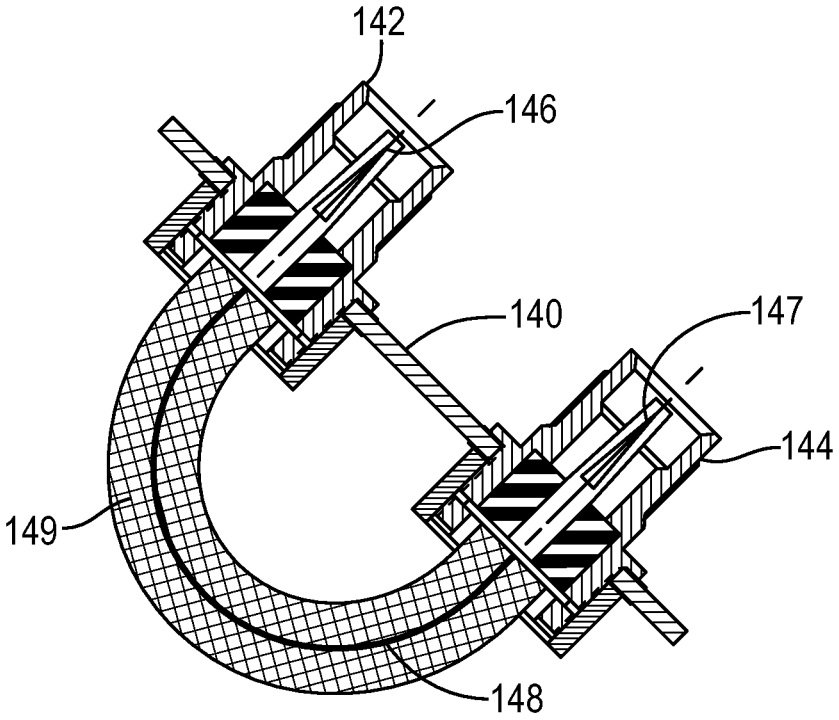
FIG. 11 is a cross-sectional view taken along reference line 11-11 in FIG. 10.

Referring to FIGS. 10 and 11, the coaxial switch 100 further comprises a support plate 140 which is attached to the section 124 of the shaft 120. The support plate 140 comprises a pair of spaced apart conductor members 142 and 144. The conductor members 142 and 144 have conductors 146 and 147, respectively. A conductive member 148 is disposed within a shield 149 and is conductively joined to the conductors 146 and 147 to form a signal path. Each conductor member 142 and 144 is configured to be inserted into the interior 116 of any coaxial connector body member 114.

The shaft 120 is capable of axial movement. Since the support plate 140 is attached to the shaft 120; the support plate will also be axially displaced when the shaft is axially displaced. When the direction of the axial movement of the shaft 120 is towards the first end 106 of the housing 102 and the conductor members 142 and 144 are aligned with the desired coaxial connector body members 114; the conductor members are inserted through the appropriate connector openings 110 and into the interiors 116 of the desired coaxial connector body.

In a preferred embodiment, the conductor members 142 and 144 are female-type coaxial connector conductors. In one embodiment, each of these female-type connector conductors is a female N-type connector. However, it is to be understood that other types of coaxial connector configurations are possible and that the invention is not limited to female N-type connectors.

Referring again to FIG. 9, the housing 102 includes an annular structure 150 that is joined to or formed on the inner wall 105. The annular structure 150 defines a bore or passageway 152 that leads to the central opening 112 in the second end 108. A radial force producing member 154 is mounted on the section 124 of the shaft 120 adjacent to the beveled portion 134. The radial force producing member 154 is located between the intermediate section 130 and the annular structure 150. In a preferred embodiment, the radial force producing member 154 is a garter spring, specifically an extension garter spring which exerts inward radial force resisting expansion.

When an axial force is exerted on the shaft 120 as indicated by arrow 160 (see FIG. 9), the intermediate section 130 moves toward the annular structure 150 such that the beveled portion 134 and the radial force producing member 154 move into the passageway 152 wherein the intermediate section forcibly contacts the radial force producing member to exert a radial force on the shaft 120; thereby, creating resistance.

The coaxial switch 100 further comprises an axial force producing mechanism 170 on the first section 122 of the shaft 120. The axial force producing mechanism 170 comprises a retainer device 172 that is attached to the distal end 128.

In one embodiment, the retainer device 172 is attached to the distal end 128 via a screw or fastener 176. In such an embodiment, the screw 176 is threadedly engaged with a threaded bore formed in the first section 122. In one embodiment, the retainer device 172 is substantially flat. In a preferred embodiment, the retainer device 172 is substantially circular in shape. In another embodiment, the retainer device 172 is a metal washer.

The axial force producing mechanism 170 further comprises a spring member 180 that is interposed between the retainer device 172 and the first end 106 of the housing 102. The spring member 180 produces a constant and pushing axial force onto the retainer device 172 which then pulls the shaft 120 and the support plate 140 toward the first end 106 of the housing 102. This constant axial force is indicated by arrow 182 in FIG. 9.

In an alternate embodiment, the retainer device 172 and the fastener 176 are not used and the distal end portion 128 is formed with a diameter that is greater than the diameter of the first section 122. In such an embodiment, the spring member 180 is interposed between the enlarged distal end portion 128 and the first end 106 of the housing 102.

The coaxial switch 100 further comprises a knob or handle 200 that is attached to the third section 126 of the shaft 120. The knob 200 enables a user to pull the shaft 120 in a direction indicated by arrow 160 that is opposite the axial force produced by the axial force producing mechanism 170 and to rotate the shaft 120 to different positions.

A user may form a signal path between coaxial cables that are connected to corresponding coaxial connector body members 114 on the first end 106 of the housing 102. The user accomplishes this by using the knob 200 to pull the shaft 120 in a direction indicated by the arrow 160 with a force sufficient to overcome the axial force produced by axial force producing member 170 and the radial force produced by radial force producing member 154. The user pulls the knob 200 outward for a distance "Z" shown in FIG. 7 in order to disengage the coaxial switch 100.

Once the user pulls the knob 200 outwardly with the requisite force; the user then rotates the shaft 120 so that the conductor members 142 and 144 on the support plate 140 are aligned with the appropriate pair of connector body members 114. Alignment is achieved by a stop in motion in that the support plate 140 limits the amount of rotation. The connectors can only move ninety degrees such that the plate 140 will stop and the user can release the knob 200. The user then releases the knob 200 so that the axial force produced by axial force producing mechanism 170 pulls or draws the conductor members 142 and 144 into the appropriate coaxial connector body members 114 so that the conductors 146 and 147 conductively contact the conductors in the coaxial cables that are attached to the coaxial connector body members.

In order to create a signal path between another pair of coaxial cables that are attached to the coaxial connector body members 114; the user pulls the knob 200 for a distance "Z" in the direction indicated by arrow 160 and then rotates the shaft 120 so that the conductor members 142 and 144 are aligned with a different combination of coaxial connector body members. The user then releases the knob 200 so that the axial force produced by axial force producing mechanism 170 pulls or draws the conductor members 142 and 144 into the interiors 116 of the different combination of coaxial connector body members 114. This action forms a signal path between the coaxial cables connected to these desired coaxial connector body members 114.

It will be understood that many additional changes in the details, materials, steps and arrangement of parts, which have been herein described and illustrated in order to explain the nature of the invention, may be made by those skilled in the art within the principle and scope of the invention as expressed in the appended claims.

The foregoing description of the preferred embodiments of the invention has been presented for purposes of illustration and description only. It is not intended to be exhaustive nor to limit the invention to the precise form disclosed; and obviously many modifications and variations are possible in light of the above teaching. Such modifications and variations that may be apparent to a person skilled in the art are intended to be included within the scope of this invention as defined by the accompanying claims.

What is claimed is:

1. A coaxial switch comprising:

a housing having an interior, an inner wall surrounding the interior and a plurality of connector openings therein which are in communication with the interior of said housing, a first opening at a first location of said housing and a second opening at a second location of said housing with a passageway in communication with the second opening;

a plurality of coaxial connector body members mounted to said housing, wherein each of said connector body members is mounted over a corresponding connector opening of the connector openings with each of said connector body members configured to be connected to a coaxial cable;

a shaft extending through and rotatably mounted to said housing, said shaft having one section within the interior of said housing, another section extending from the opening in said housing at the first location and an additional section extending from the opening in said housing at the second location, said section of said shaft within the interior of said housing having a first diameter and an intermediate section having a second diameter greater than the first diameter, wherein said intermediate section is sized to fit into the passageway;

a support plate mounted to said section of said shaft within the interior of said housing;

a pair of conductor members joined to said support plate, wherein each conductor member comprises a conductor and is configured to be inserted into any of said coaxial connector body members;

a conductive member conductively joined to each conductor to form a signal path;

an axial force producing mechanism mounted to said section of said shaft extending from said housing at the first location with said axial force producing mechanism capable of producing an axial force on said shaft that urges said support plate against the inner wall of said housing so that said support plate impacts said plurality of connector openings;

a radial force producing member mounted on said shaft adjacent to said intermediate section, wherein said intermediate section and said radial force producing member are drawn into the passageway when an axial force opposite to and greater than the axial force produced by said axial force producing mechanism is exerted on said shaft and wherein said radial force producing member exerts a radial force on said shaft when said intermediate section forcibly contacts said radial force producing member within the passageway;

a knob attached to said section of said shaft extending from said housing at the second location to enable a user to pull said shaft in a direction that is opposite to the axial force produced by said axial force producing mechanism, to rotate said shaft to a different position and then to release said knob to enable the axial force produced by said axial force producing member to urge said support plate member against said inner wall of said housing so that said conductor members are inserted into appropriate connector body members and said conductors of said conductor members conductively contact said conductors of the coaxial cable; and a retainer device attached to said section of said shaft extending from said housing at the first location;

wherein said section of said shaft extending from the opening in said housing at the first location has a first diameter;

wherein said retainer device has a diameter that is greater than the first diameter.

2. The coaxial switch according to claim 1 wherein said axial force producing member comprises a spring interposed between said retainer device and said housing.

3. The coaxial switch according to claim 1 wherein said section of said shaft extending from the opening in said housing at the first location has a distal end and said retainer device is attached to the distal end.

4. The coaxial switch according to claim 3 wherein said retainer device is circular in shape and has a second diameter that is greater than the first diameter.

* * * * *